US006766605B2

(12) United States Patent
Emert

(10) Patent No.: US 6,766,605 B2
(45) Date of Patent: Jul. 27, 2004

(54) METHOD AND APPARATUS FOR ILLUMINATING ADVERTISING AND MARKETING METERED AND UNMETERED PARCEL AND PACKAGE SMART DROP BOXES AND RECEPTACLES

(76) Inventor: David Scot Emert, 3059 Brentmoor Dr., St. Charles, MO (US) 63301

( * ) Notice: Subject to any disclaimer, the term of this patent is extended or adjusted under 35 U.S.C. 154(b) by 0 days.

(21) Appl. No.: 10/183,917

(22) Filed: Jun. 28, 2002

(65) Prior Publication Data

US 2004/0000079 A1 Jan. 1, 2004

(51) Int. Cl.[7] ..... G09F 23/00

(52) U.S. Cl. ..... 40/566; 40/902; 40/463; 363/154; 232/30; 232/34; 232/35; 232/37

(58) Field of Search ..... 40/564, 566, 606.06, 40/567, 902, 463; 362/154, 812; 232/27, 30, 34, 35, 37

(56) References Cited

U.S. PATENT DOCUMENTS 2,448,945 A * 9/1948 Zacharaias ..... 40/566
4,441,143 A * 4/1984 Richardson, Jr. ..... 362/812
4,827,645 A * 5/1989 Stamps, Jr. ..... 40/567
5,467,076 A * 11/1995 Ruocco et al. ..... 362/812
5,818,336 A * 10/1998 Varga et al. ..... 232/37
5,967,355 A * 10/1999 Ragot ..... 362/812
6,119,622 A * 9/2000 Banerjea ..... 232/35
6,299,325 B1 * 10/2001 Cathel ..... 40/566

* cited by examiner

*Primary Examiner*—Gary Hoge
(74) *Attorney, Agent, or Firm*—Henry W. Cummings

(57) ABSTRACT

A normal four sided drop box 10 is provided with with new panels 12 which are made from translucent material replacing the standard solid metal or aluminum side, front and rear panels currently employed. The panels are placed on the sides, rear and front of the drop box or receptacle. At least one internal light source 20 (LED, Incandescent, etc.) is placed inside the box to be visible through the translucent material applied in place of the solid metal covering. A consumer thus sees the illuminated panels from the outside of the drop box or receptacle. But the internal components 30 are unseen and hidden from view. In one embodiment the companies or individuals message, logo, script, 22 is backlit by the internal light source 20 makes the message visible at night. A power source battery 50 is preferably powered by solar panel 40.

17 Claims, 3 Drawing Sheets

METHOD AND APPARATUS FOR ILLUMINATING ADVERTISING AND MARKETING METERED AND UNMETERED PARCEL AND PACKAGE SMART DROP BOXES AND RECEPTACLES

I FIELD OF THE INVENTION

This invention relates to a Method and Apparatus for Illuminating Advertising and Marketing Metered and Unmetered Parcel and Package Smart Drop Boxes and Receptacles, and to a Method of Data Collection and Communication of Metered and Unmetered Parcel and Package Smart Drop Boxes and Receptacles

II BACKGROUND OF THE INVENTION

U.S. Pat. No. 6,263,601 hereby incorporated into the present application by this reference discloses apparatus for lighting real estate signs and a method of advertising.

The current drop box techniques involve unlit boxes with normal ambient illumination required for visibility. Current methods do not allow for consumers to easily identify drop boxes or package receptacles after dusk

III SUMMARY OF THE INVENTION

A. OBJECTS

One object of the present invention is to apply state of the art electronics and LED technology to automatically illuminate the drop boxes or receptacles for packages, letters, etc.

Another object of the present invention is to automatically illuminate the drop box at dusk.

Another object of the present invention is to provide for a means to locate and identify the drop box in the vicinity in which it is located.

B. SUMMARY

The normal drop box is provided with with new panels which are made from translucent material replacing the standard solid metal or aluminum side, front and rear panels currently employed. The panels are placed on the sides, rear and front of the drop box or receptacle. At least one internal light source (LED, Incandescent, etc.) is placed inside the box to be visible through the translucent material applied in place of the solid metal covering. A consumer thus sees the illuminated panels from the outside of the drop box or receptacle. But the internal components would be unseen and hidden from view. In one embodiment the companies or individuals message, logo, script, etc is backlit by the internal light source makes the message visible at night. In another embodiment a solar panel is to charge a battery. This eliminates the need for external power requirements or changing of batteries on a daily or regular basis. In another embodiment known state of the art electronics is used to provide for controls, operation and logic used in the illuminated products. The unit would thus operate without intervention for long periods of time with a renewable energy cycle provided by the solar panel. This allows power on demand at any location where it was not practical or attainable in the past. This eliminates the need for costly wiring or permits to provide for power at the units. The advertising unit or display are self-illuminating and self sufficient without intervention for long periods of time. LED units are applied to allow correct light output without large energy requirements, and provide for a virtually non-breakable light source providing for long life and durability. To provide customers with peace of mind and integrity to their services, the receptacle or drop box provider could offer methods to provide proper indication to the customer. The panels made from translucent sign grade plastic resin, glass etc. are placed on the drop box or similar parcel receptacle. The logo, message, is placed on the translucent face. The battery is placed inside the unit at a strategic point to hide the item. Known circuity including printed circuit boards aqre used for proper control and placed inside the unit as well. LED's or similar light source are placed behind the translucent faces so as to provide illumination for the translucent panels. At dusk the LED's automatically backlight the translucent panels by means of a photo eye, photo diode, Typically this is a a white backlight, but any color can be used. The electronic includes a built in clock which is set to automatically start to flash the LED's to create a flashing backlit message at a predetermined time prior to parcel pick up. As the attendant opens te drop box or receptacle, a limit switch is activated to automatically send a message to the circuitry to start the backlight flashing in a different color to indicate that the attendant had picked up the parcel s at the box. The lighting circuitry povides a quick and undisputed method to determine this from a distance and very quickly. This system is powered by a battery operated system and solar panel for recharging providing for a continuous repeatable cycle every day. The backlit panels would also act as the normal display panels for daytime use since the panels would conceal the inside of the box and provide for normal advertising and display during the day. The organization using this technology may communicate with each drop box or receptacle remotely and gather, retrieve and store the information they require from each drop box or receptacle.

IV THE DRAWINGS

V DESCRIPTION OF PREFFERRED EMBODIMENTS

Figure 1:
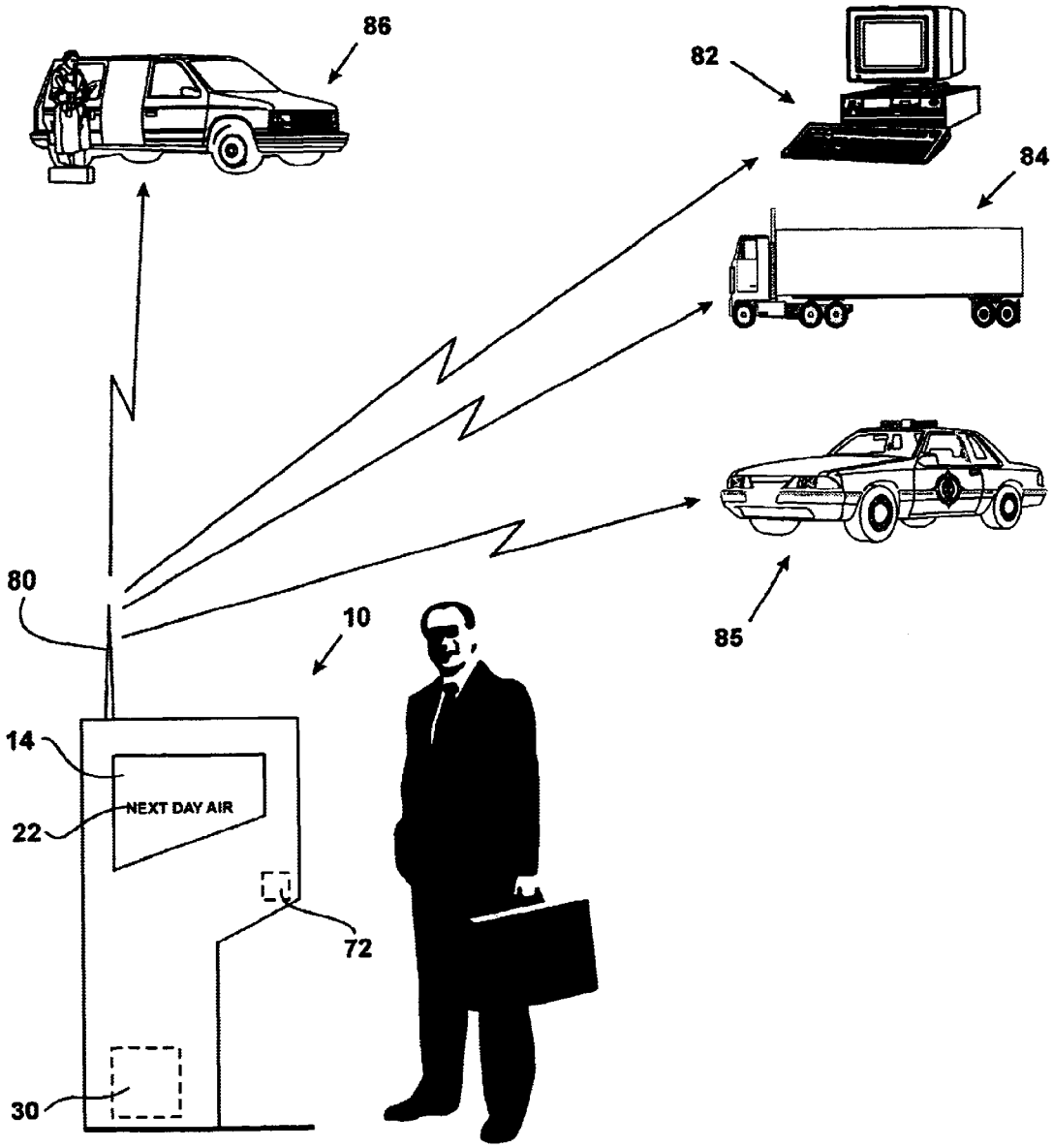
FIG. 1 is a schematic side elevation view of a lighted drop box according to the present invention.
Figure 2:
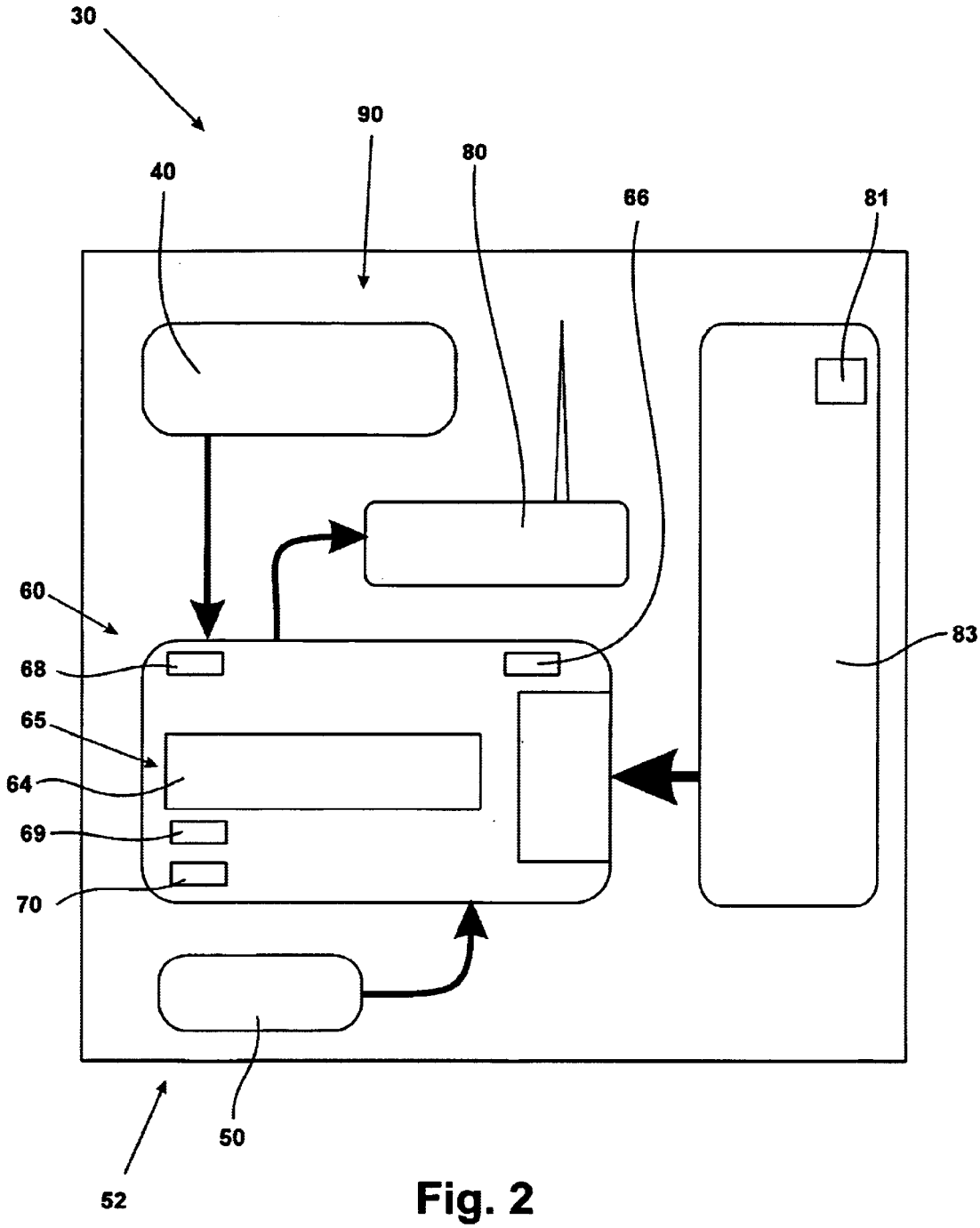
FIG. 2 is a schematic view of the operation of the lighted drop box according to the present invention.
Figure 3:
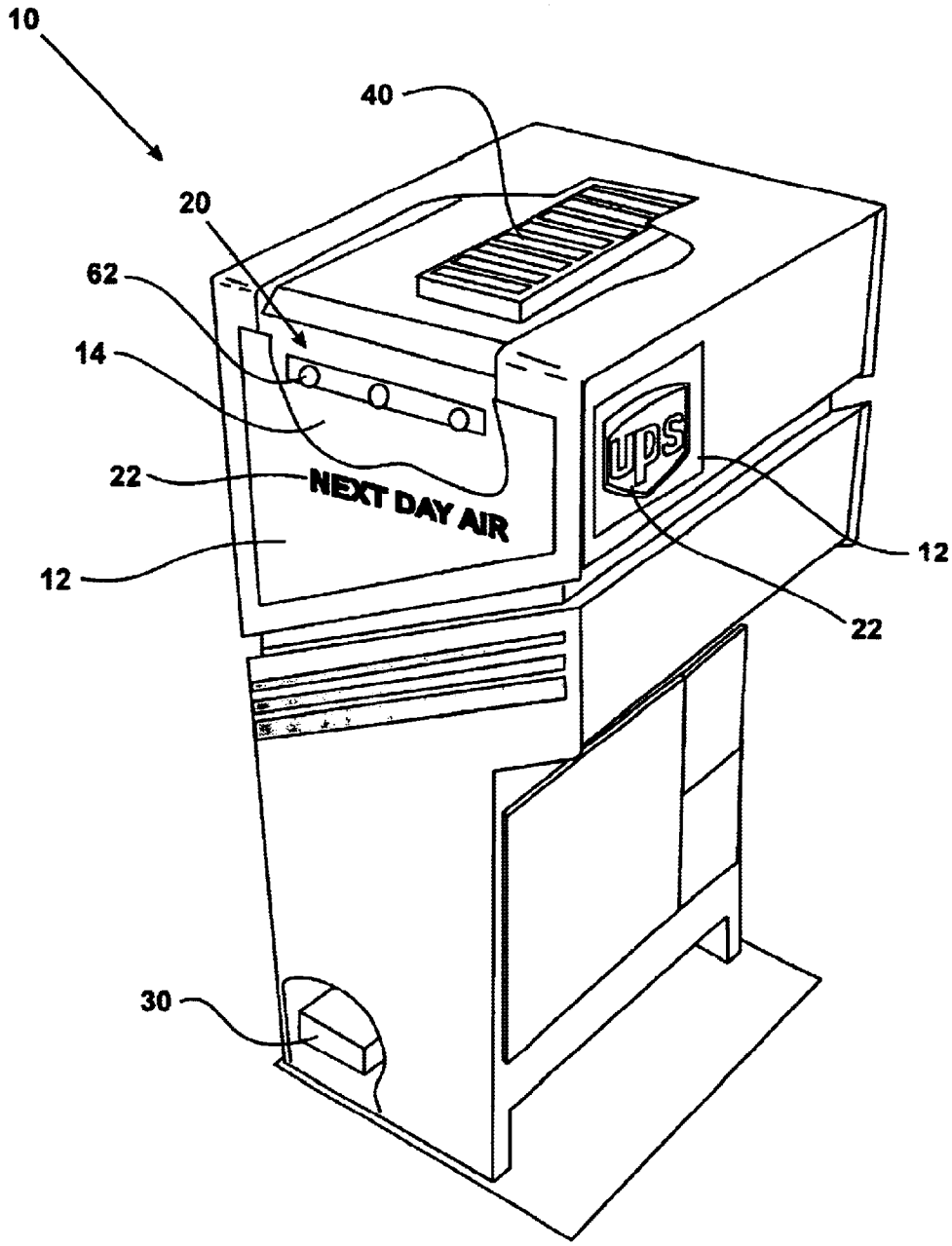
FIG. 3 is a schematic perspective view of the lighted drop box according to the present invention.

A normal four sided drop box 10 is provided with new panels 12 which are made from translucent material replacing the standard solid metal or aluminum side, front and rear panels currently employed. The panels are placed on the sides, rear and front of the drop box or receptacle. At least one internal light source 20 (LED, Incandescent, etc.) is placed inside the box to be visible through the translucent material applied in place of the solid metal covering. A consumer thus sees the illuminated panels from the outside of the drop box or receptacle. But the internal components 30 are unseen and hidden from view. In one embodiment the companies or individuals message, logo, script, 22 is backlit by the internal light source 20 makes the message visible at night.

In another embodiment a solar panel is used to charge a battery 50. This eliminates the need for external power requirements or changing of batteries on a daily or regular basis.

In another embodiment known state of the art electronics 60 are used to provide for controls, operation and logic used in the illuminated products. The unit would thus operate without intervention for long periods of time with a renewable energy cycle provided by the solar panel 40. This allows power on demand at locations where it was not practical or attainable in the past. This also eliminates the need for costly wiring or permits to provide for power at the units. The advertising unit or display would be self-illuminating and self sufficient without intervention for long periods of time.

LED units 62 is utilized would be applied to allow correct light output without large energy requirements. The LED's would also provide for a virtually non-breakable light source providing for long life and durability. To provide customers with peace of mind and integrity to their services, the receptacle or drop box provider could offer methods to provide proper indication to the customer.

Panels 12 may also be made from translucent sign grade plastic resin, glass and may be placed on the drop box 10 or similar parcel receptacle. The logo, message, 22 may be placed on the translucent face 14, and may be placed wherever the customer would choose to locate.

The battery 50 is placed inside the unit at a point 52 to hide the item. Known electronic circuits 64 including printed circuit boards 65 may be used for proper control. LED's 62 are placed behind the translucent faces 14 so as to provide illumination for the translucent panels. At dusk the LED's 62 automatically backlight the translucent panels by means of a photo eye, photo diode, 66. As an example this may be a white backlight 68, but any color can be used.

The electronic circuits 64 would have a built in clock 69 which is set to automatically start to flash the LED's 62 to create a flashing backlit message 70 at a predetermined time prior to parcel pick up. As the attendant opens the drop box or receptacle 10, a limit switch 72 automatically sends a message to the circuitry 64 to start the backlight 68 flashing in a different color to indicate that the attendant has picked up the parcel s at the box. This lest the consumer know that the parcels had been retrieved. In this manner the consumer does not have to guess if the parcels were picked up or if the driver was still enroute. This would provide safety and indication for the consumer to locate another drop box. Too many times the consumer has dropped parcels near pick up time to find the next day that the parcel was not delivered due to the driver coming early to the drop box. Consumers need peace of mind, and quickly when they are in a hurry or under stress to locate a drop box.

The lighting sustem provides for a quick and undisputed method to determine this from a distance and very quickly. After a preset period of time the flashing pickup indicating light 68 returns to the solid original backlit color for the remainder of the evening.

As mentioned above, this cycle is powered by a battery operated system 50 and solar panel 40 for recharging, providing for a continuous repeatable cycle every day. The backlit panels would also act as the normal display panels for daytime use. The panels conceal the inside of the box and provide for normal advertising and display during the day. Thus the box would serve as a 24-hour drop box or package or letter receptacle. This would have application in companies such as FEDEX, UPS, Airborne Express, the US Postal Service, etc for their drop box technologies and advertising.

As part of the solar recharging system and battery power storage, other data gathering and acquisition methods can also be employed. Any type of digital system such as a cellular system 80 can be installed and maintained by the battery rechargeable system. This allows the company or individual employing the drop box technology to communicate with each drop box or receptacle remotely and gather, retrieve and store the information they require from each drop box or receptacle by means of a cellular dialing network 82. Each drop box 10 has its own unique address 81 accessed by the cellular or digital network 82. Information 83 on usage, package or parcel information, contents of each box, maintenance information or troubleshooting information may be gathered remotely from any location quickly and easily. A continuous power source would be available allowing the user to maintain the cellular system without intervention for long periods of time. By providing redundant systems 90 within the unit, power outage would be virtually eliminated. Each drop box would in effect be its own electrical powered and free standing and self-sustaining advertising and data acquisition system. Information and services requiring power for the customer at the drop boxes may be established due to the convenience of on site free standing power without the need for external wiring. This allows the firm or individual utilizing the drop box to place the unit virtually anywhere sunlight is available. It would be as simple as drop the unit in place, anchor into position and walk away. No external means are necessary for operation. The solar powered battery system 40–50 provides all necessary power for all operations required at the drop box.

Similarly this system may be used to back light advertising displays by placing the components internal to the standard advertising media. This applies to corner vending machines, newspaper receptacles, corner signs for advertising restaurants, sundries, etc. where normal power means are not practical or available. Pizza delivery rooftop illuminated advertising may also be replaced by freestanding solar recharged backlit units free of plugs or cords. Novelty figurines such as Santa, Snowmen, Reindeers and the like may also eliminate unsafe and troublesome extension chords. By adding the solar recharging technology, the electronicsystem the and the LED systems for lighting and by combining this with correct selection of state of the art plastics and resins to achieve the correct lighting output, free standing illuminated displays, advertising, etc can be established for safe and worry free applications. No other power sources would be required. The advertisements and displays could be located in any area where available sunlight exits to provide self-illuminating technology for lighting any type of advertising or display item.

What is claimed is:

1. A drop box comprising:

at least one panel made from translucent material located on at least one side, front or rear of the box;

at least one internal light source located inside the box and visible through the translucent material for illuminating information on the box;

at least one power source to power said light source;

electrical circuity control means located inside said unit;

communicating means for communicating with each drop box or receptacle remotely to gather, retrieve and store the information from each drop box or receptacle, and wherein said electrical circuitry includes a limit switch whereby as the attendant opens the drop box, said limit switch is activated to automatically send a message to the circuitry to start said backlight flashing in a different color to indicate that the attendant had picked up the parcels at the box.

2. A drop box according to claim 1 wherein said power source is a battery.

3. A drop box according to claim 1 wherein said message is backlit by said light source which makes the message visible at night.

4. A drop box according to claim 3 wherein means are provided to control operation and logic used in the illuminated products.

5. A drop box according to claim 1 wherein means to control operation of said light source is provided.

6. A drop box according to claim 5 wherein said power source is a battery.

7. A drop box according to claim 1 wherein a message is provided.

8. A drop box according to claim 7 wherein said message is backlit by said light source which makes the message visible at night.

9. A drop box according to claim 8 wherein means are provided to control operation and logic used in the illuminated products.

10. A drop box according to claim 9 wherein said panels are made from translucent sign grade material.

11. A drop box according to claim 9 wherein said panels are made from translucent sign grade material selected from plastic, resin, and glass.

12. A drop box according to claim 1 wherein a solar panel is placed inside the unit at a strategic point to hide said solar panel.

13. Twice amended. A drop box according to claim 1 wherein electrical circuity includes includes a built-in clock.

14. A drop box according to claim 13 wherein said electrical circuitry includes LED's and clock is set to automatically start to flash the LED's to create a flashing backlit message at a predetermined time prior to parcel pick up.

15. A drop box according to claim 14 wherein said electrical circuitry includes a limit switch whereby as the attendant opens the drop box, said limit switch is activated to automatically send a message to the circuitry to start said backlight flashing in a different color to indicate that the attendant had picked up the parcels at the box.

16. A drop box comprising:

at least one panel made from translucent material located on at least one side, front or rear of the box;

at least one internal light source located inside the box and visible through the translucent material for illuminating information on the box;

at least one power source to power said light source;

electrical circuity control means located inside said unit; and communicating means for communicating with each drop box or receptacle remotely to gather, retrieve and store the information from each drop box or receptacle said electrical circuity including a built-in clock; and wherein said electrical circuitry includes LED's and clock is set to automatically start to flash the LED's to create a flashing backlit message at a predetermined time prior to parcel pick up.

17. A drop box comprising:

at least one panel made from translucent material located on at least one side, front or rear of the box;

at least one internal light source located inside the box and visible through the translucent material for illuminating information on the box;

at least one power source to power said light source;

electrical circuity control means located inside said unit; said electrical circuity including printed circuit boards and includes at least one photo eye, or photo diode; and communicating means for communicating with each drop box or receptacle remotely to gather, retrieve and store the information from each drop box or receptacle.

* * * * *